US012426645B2

(12) United States Patent
Chen

(10) Patent No.: US 12,426,645 B2
(45) Date of Patent: Sep. 30, 2025

(54) SWADDLE BABY SLEEPING BAG

(71) Applicant: Yiwen Chen, Guangdong (CN)

(72) Inventor: Yiwen Chen, Guangdong (CN)

(73) Assignee: Shenzhen Aobeite Technology Service Co., Ltd., Shenzhen (CN)

( * ) Notice: Subject to any disclaimer, the term of this patent is extended or adjusted under 35 U.S.C. 154(b) by 0 days.

(21) Appl. No.: 18/735,778

(22) Filed: Jun. 6, 2024

(65) Prior Publication Data

US 2024/0407476 A1 Dec. 12, 2024

(30) Foreign Application Priority Data

Jun. 12, 2023 (CN) ..... 202310695202.1

(51) Int. Cl.
*A41B 13/06* (2006.01)

(52) U.S. Cl.
CPC ..... *A41B 13/06* (2013.01)

(58) Field of Classification Search
CPC ..... A41B 3/06; A41B 3/065
USPC ..... 2/69.5
See application file for complete search history.

(56) References Cited

U.S. PATENT DOCUMENTS

| | | | | |
|---|---|---|---|---|
| 9,179,711 | B2 | 11/2015 | Krawchuk | |
| 9,320,303 | B2 | 4/2016 | Howard | |
| 10,104,916 | B2 | 10/2018 | Barski | |
| D873,528 | S * | 1/2020 | Parker | D2/719 |
| 11,044,951 | B2 | 6/2021 | Mercy | |
| D1,007,103 | S * | 12/2023 | Huang | D2/719 |
| 2015/0342263 | A1* | 12/2015 | Taylor | A41B 13/06 2/69.5 |
| 2016/0255886 | A1* | 9/2016 | Arzu | A41B 13/00 |
| 2017/0311663 | A1* | 11/2017 | Wollschlaeger | A41D 15/00 |
| 2017/0318984 | A1 | 11/2017 | Parker | |
| 2019/0208831 | A1* | 7/2019 | Joshi | A41D 15/002 |
| 2024/0206565 | A1* | 6/2024 | Krawchuk | A41B 13/08 |

* cited by examiner

*Primary Examiner* — Timothy K Trieu

(57) ABSTRACT

The present disclosure provides a swaddle baby sleeping bag, which includes a sleeping bag body and a zipper arranged on the sleeping bag body. The sleeping bag body is provided with a head opening, a zipper opening and two foot openings. The head opening is located at an upper side of the sleeping bag body, the foot openings are located at a lower side of the sleeping bag body, and the zipper is arranged along the zipper opening.

18 Claims, 3 Drawing Sheets

SWADDLE BABY SLEEPING BAG

CROSS REFERENCE TO RELATED APPLICATIONS

This application claims priority benefits to Chinese Patent Application No. 2023106952021, filed on Jun. 12, 2023, the contents of which are incorporated herein by reference.

TECHNICAL FIELD

The present disclosure relates to the technical field of sleeping bags, and in particular, to a swaddle baby sleeping bag.

BACKGROUND

Wrapping is a globally recognized and effective way to help a baby solve sleep problems and improve its sleep quality. A newborn baby appear insecure as it leaves its mother's womb. A traditional wrapping towel is cumbersome to wrap the newborn baby. Sometimes the wrapping is not good enough, for example, too tight or too loose, which may easily cause startle reflex and make the baby less comfortable. In order to solve the problem of a traditional wrapping, a swaddle baby sleeping bag was designed. However, a bottom edge of an existing sleeping bag is sealed, and the baby's feet cannot be stretched out when it wants to, causing discomfort to the baby.

SUMMARY

A swaddle baby sleeping bag includes a sleeping bag body and a zipper arranged on the sleeping bag body. The sleeping bag body is defined with a head opening, a zipper opening and two foot openings, the head opening is located at an upper side of the sleeping bag body, the foot openings are located at a lower side of the sleeping bag body, and the zipper is arranged along the zipper opening.

BRIEF DESCRIPTION OF DRAWINGS

The description and drawings that constitute a part of the present disclosure are provided for a further understanding of the present disclosure. The illustrative embodiments and their descriptions are provided for explanation but do not constitute an improper limitation of the present disclosure.

DETAILED WAY

In order to facilitate understanding of the present disclosure, the present disclosure will be described more fully below with reference to the relevant drawings. Some embodiments of the disclosure are shown in the accompanying drawings. However, the disclosure may be implemented in many different forms and is not limited to the embodiments described herein. Rather, these embodiments are provided to facilitate a thorough understanding of the present disclosure.

When an element is referred to as being "fixed" to another element, it may be directly on the other element or intervening elements may also be present. When an element is said to be "connected" to another element, it may be directly connected to the other element or there may also be intervening elements present. In addition, the term "and/or" in the present disclosure is only an association relationship that describes related objects, indicating that there may be three relationships. For example, A and/or B may mean: A alone exists, A and B exist simultaneously, and B alone exists.

Unless otherwise defined, all technical and scientific terms used herein have the same meaning as commonly understood by those of ordinary skill in the technical field to which the present disclosure belongs. The terms used herein in the description of the present disclosure are only for the purpose of describing specific embodiments, such as "inner", "outer", "left", "right" and similar expressions are only for the purpose of illustration and are not are intended to limit the present disclosure.

Figure 1:
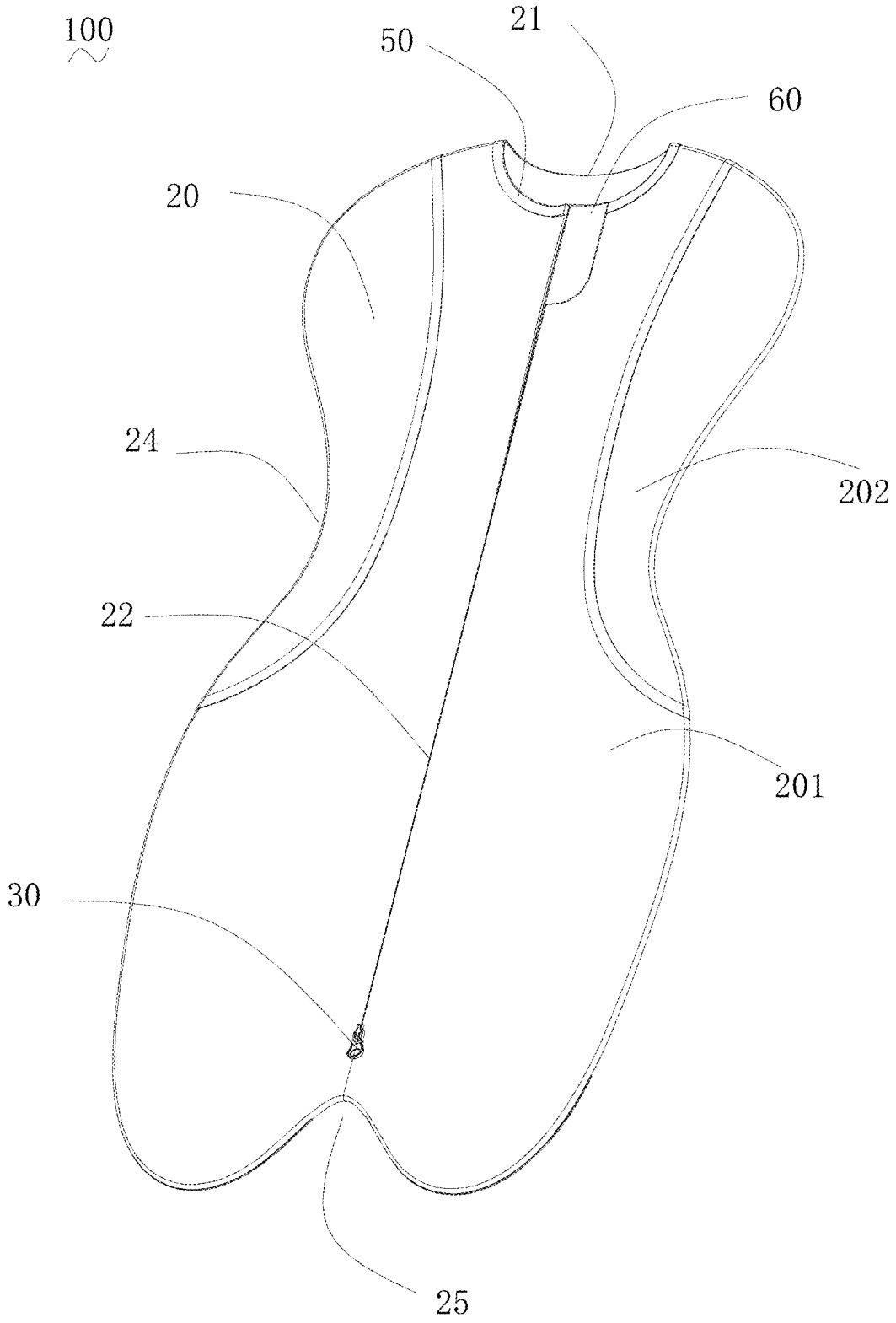
FIG. 1 is a schematic view of a swaddle baby sleeping bag according to the present disclosure.
Figure 2:
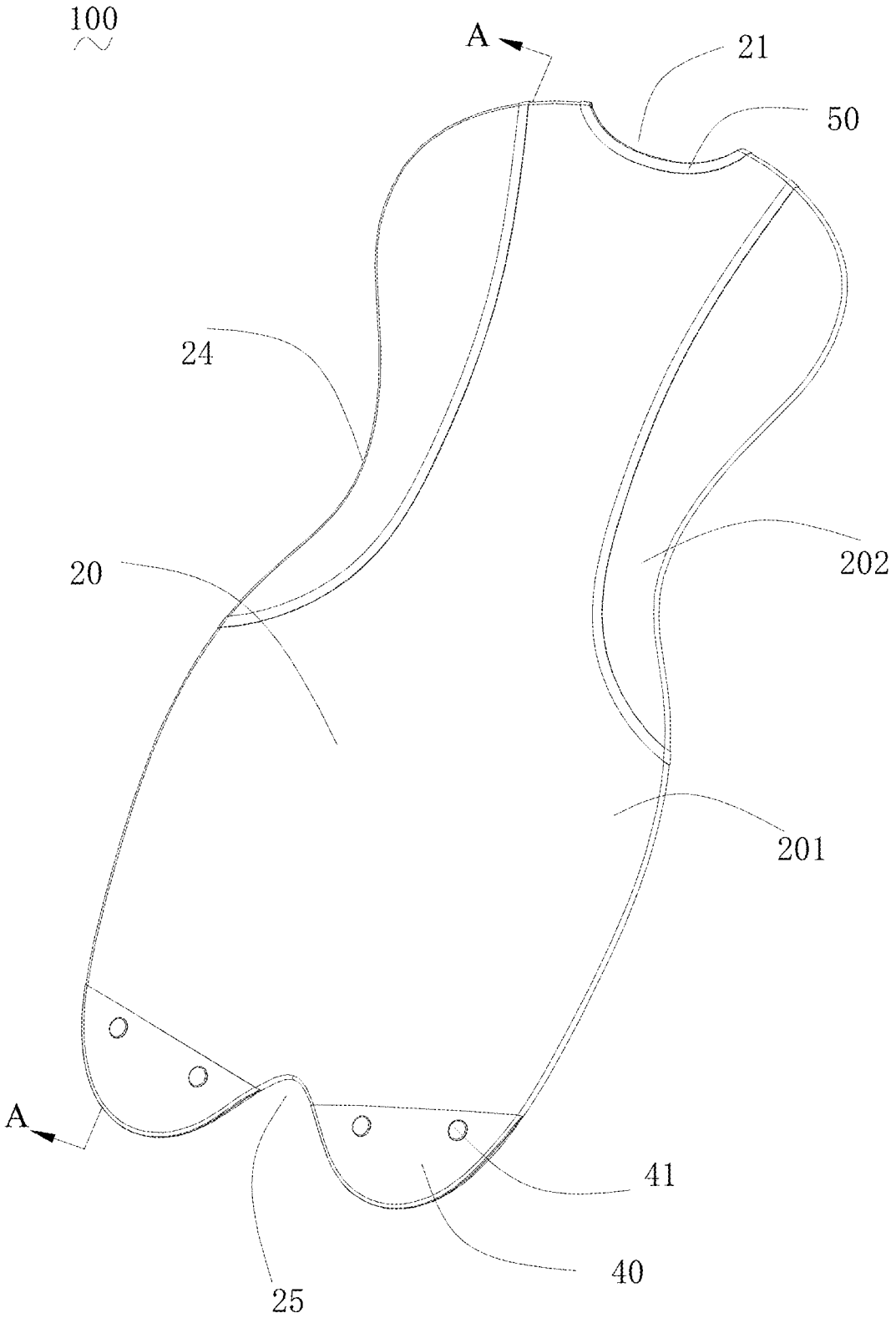
FIG. 2 is a schematic view of the swaddle baby sleeping bag shown in FIG. 1 from another perspective.
Figure 3:
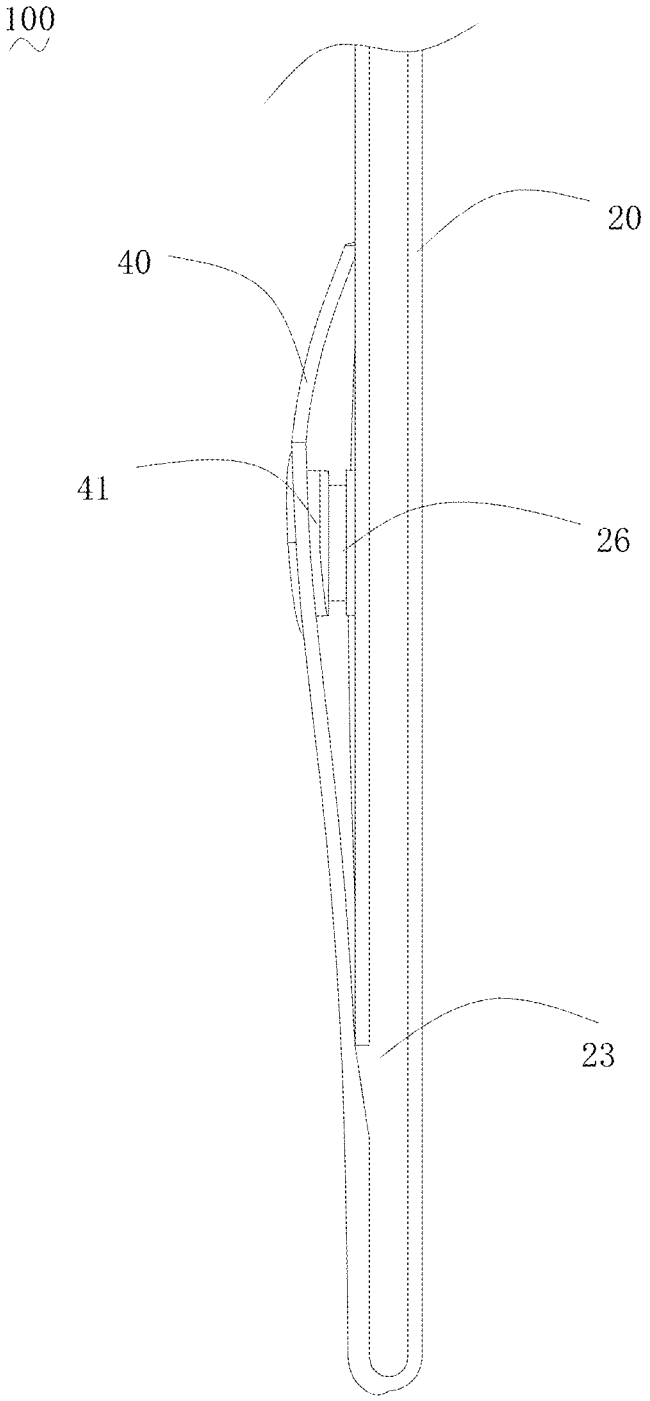
FIG. 3 is a partial cross-sectional view along A-A direction shown in FIG. 2.

As illustrated in FIG. 1 to FIG. 3, which are schematic views of a swaddle baby sleeping bag 100 of the present disclosure. The swaddle baby sleeping bag 100 includes a sleeping bag body 20, a zipper 30 and two shielding cloths 40 arranged on the sleeping bag body 20. The zipper 30 is convenient for the parents of the baby to change diapers, and the sleeping bag body 20 is made of fabric that is skin-friendly and meets Class A standards. The swaddle baby sleeping bag 100 has a butterfly shape as a whole, which fits the baby's body shape better. The overall fabric material is one-way moisture-conducting fabric, which may not overheat, reduce the possibility of red rash, keep dry, quickly absorb moisture and sweat, and is able to extend the baby's sleeping time.

In some embodiments, the sleeping bag body 20 is defined with a head opening 21, a zipper opening 22 and two foot openings 23. The head opening 21 is located at an upper side of the sleeping bag body 20. The zipper opening 22 is in communication with the head opening 21, and the foot openings 23 are located at a lower side of the sleeping bag body 20. The zipper 30 is arranged along the zipper opening 22, and shielding cloths 40 is arranged opposite to the foot openings 23. The shielding cloths 40 may fold or unfold the foot openings 23. In an embodiment, the zipper opening 22 extends along a longitudinal direction of the sleeping bag body 20, and the zipper 30 is arranged in a straight line on the zipper opening 22. In another embodiment, the zipper opening 22 may be arranged in an arc, and the zipper 30 is arranged in an arc on the zipper opening 22. For example, the zipper 30 extends from the head opening 21 to a side of the sleeping bag body 20.

In some embodiments, side recesses 24 are symmetrically provided on two sides of the sleeping bag body 20, and a lower recess 25 is provided on a lower side of the sleeping bag body 20. The lower recess 25 is located between the two foot openings 23, such that it fits the baby's body. Each side recess 24 is an area with fabric. In other words, each of the side recesses 24 is a closed space which does not allow the baby's arms to stretch out of the sleeping bag body 20. The baby's arms are placed on the side recesses 24 to allow the baby to have a sense of restraint, which may reduce the baby's startle reflex and make it more comfortable to wear.

In some embodiments, the swaddle baby sleeping bag 100 also includes a protective strip 50 arranged on the sleeping bag body 20. The protective strip 50 is disposed along an edge of the head opening 21. Through the arrangement of the protective strip 50, the baby's neck may be protected and the possibility of friction which produces scratches on the baby's neck may be reduced.

In some embodiments, the swaddle baby sleeping bag 100 further includes a zipper barrier 60 arranged on the sleeping bag body 20, and a width of the zipper barrier 60 is greater than that of the zipper 30. During use, when the zipper 30 is pulled to the top, it is located under the zipper barrier 60, such that the zipper barrier 60 isolates the top of the zipper 30 from the baby's body and reduces the possibility of the top of the zipper 30 touching or scratching the baby's neck or face.

In some embodiments, the sleeping bag body 20 is equipped with a button seat 26, and the shielding cloth 40 is equipped with a button disk 41. The button disk 41 and the button seat 26 are matched and snap-fitted, such that the folding or unfolding between the shielding cloth 40 and the foot opening 23 may be completed. In some embodiments, the button seat 26 is located at a side of the foot opening 23 away from the shielding cloth 40, which facilitates the formation of a relatively sealed protection space when the shielding cloth 40 is fastened. In the present embodiment, the button seats 26 are arranged in groups of two on the side of the foot opening 23 away from the shielding cloth 40, and the shielding cloth 40 extends from the sleeping bag body 20 in a direction away from the foot opening 23.

In some embodiments, the sleeping bag body 20 includes a main body fabric area 201 and waist and hand fabric areas 202. The waist and hand fabric areas 202 are symmetrically arranged on both sides of the main body fabric area 201. The elasticity of the waist and hand fabric areas 202 is greater than that of the main body fabric area 201. The waist and hand fabric area 202 is provided with a recess, and the recess faces the main body fabric area 201. In this way, the waist area is relatively narrow and has a sense of restraint, and the position corresponding to the baby's hip is relatively wide. It is suitable for M-shaped legs and is helpful for the development of the baby's hip joints. Since the waist and hand fabric area 202 has greater elasticity and is relatively wider to the baby's arm, the baby's arms may be spread upwards and downwards to both sides, straightened, and may be stretched freely, etc., Meanwhile, a sense of wrapping may reduce the baby's startle reflex, there is room for the arms to be placed on both sides of the waist, and the shoulders of a relatively heavy baby may also be used, making it highly practical.

When using the above-mentioned swaddle baby sleeping bag 100, open the swaddle baby sleeping bag 100 through the zipper 30 and put it on the baby. Since the sleeping bag body 20 is provided with two foot openings 23 on the lower side, and the sleeping bag body 20 is arranged with the two shielding cloths 40 opposite to the foot openings 23, the folding and unfolding state of the shielding cloths 40 may be changed as needed. When the baby's feet are not suitable to be stretched out, the shielding cloths 40 may be used to cover the foot openings 23. When the baby's feet need to be stretched out, the shielding cloths 40 may be opened to let the feet stretch out. It is comfortable to wear, very flexible and practical.

In some embodiments, as illustrated in FIG. 1, the sleeping bag body 20 includes a first side and a second side connected together and opposite to each other. The zipper 30 is arranged on the first side of the sleeping bag body 20. Two shielding cloths 40 are arranged on an lower side of the first side of the sleeping bag body 20.

In some embodiments, as illustrated in FIG. 1, the first side includes a first portion and a second portion, and the zipper opening 22 is defined between the first portion and the second portion.

In some embodiments, as illustrated in FIG. 1 and FIG. 2, a lower recess 25 is formed between a lower part of the first portion and a lower part of the second portion.

In some embodiments, as illustrated in FIG. 1, FIG. 2 and FIG. 3, the button seat 26 is arranged on the second side of the sleeping bag body 20, and the button disk 41 is arranged on the shielding cloth 40.

In some embodiments, as illustrated in FIG. 1, FIG. 2 and FIG. 3, the quantity of the button disk 41 arranged on the shielding cloths 40 is the same as that of the button seat 26 arranged on the second side of the sleeping bag body 20. For example, two button disk 41 are arranged on one shielding cloth 40, and the sleeping bag body 20 is arranged with a total of four button seats 26.

The technical solution complies with the principles of ergonomics. The baby is just like in its mother's womb. It reduces the startle reflex and reduces the possibility of the baby catching cold as a result of kicking the quilt. With the arms in the sleeping bag, it will be easier for the mother to breastfeed. Restraining the arms may also reduce the occurrences of the baby scratching and hurting the face.

The technical features of the above embodiments may be combined in any way. To simplify the description, not all possible combinations of the technical features in the above embodiments are described. However, as long as there is no contradiction in the combination of these technical features, all should be considered to be within the scope of the present disclosure.

The above-described embodiments only express several implementation modes of the present disclosure, and their descriptions are relatively specific and detailed, but they should not be construed as limiting the protection scope of the present disclosure. For those of ordinary skill in the art, several modifications and improvements may be made without departing from the concept of the present disclosure, and these all belong to the protection scope of the present disclosure. Therefore, the protection scope of the present disclosure should be determined by the appended claims.

What is claimed is:

1. A swaddle baby sleeping bag, comprising a sleeping bag body and a zipper arranged on the sleeping bag body; wherein the sleeping bag body is defined with a head opening, a zipper opening and two foot openings, the head opening is located at an upper side of the sleeping bag body, the foot openings are located at a lower side of the sleeping bag body, and the zipper is arranged along the zipper opening;

wherein the sleeping bag body comprises a main fabric area and two waist and hand fabric areas, each of the two waist and hand fabric areas is symmetrically arranged on one side of the main body fabric area, and an elasticity of the waist and hand fabric areas is greater than an elasticity of the main fabric area.

2. The swaddle baby sleeping bag according to claim 1, wherein each waist and hand fabric area comprises a side recess, and the side recess faces the main fabric area.

3. The swaddle baby sleeping bag according to claim 2, wherein the side recess is an area with fabric.

4. The swaddle baby sleeping bag according to claim 1, wherein the baby sleeping bag is in a shape of a butterfly as a whole.

5. The swaddle baby sleeping bag according to claim 1, further comprising a protective strip arranged on the sleeping bag body, wherein the protective strip is arranged along an edge of the head opening.

6. The swaddle baby sleeping bag according to claim 1, further comprising a zipper barrier arranged on the sleeping bag body.

7. The swaddle baby sleeping bag according to claim 6, wherein a width of the zipper barrier is greater than a width of the zipper.

8. The swaddle baby sleeping bag according to claim 1, further comprising two shielding cloths arranged on the sleeping bag body, wherein each of the two shielding cloths is arranged opposite to each of the two foot openings respectively.

9. The swaddle baby sleeping bag according to claim 8, wherein each shielding cloth extends from the sleeping bag body in a direction away from each foot opening.

10. The swaddle baby sleeping bag according to claim 8, wherein a button seat is arranged on the sleeping bag body, a button disk is arranged on the shielding cloth, and the button disk matches the button seat.

11. The swaddle baby sleeping bag according to claim 10, wherein the sleeping bag body comprises a first side and a second side connected together and opposite to each other, the zipper is arranged on the first side of the sleeping bag body, and two shielding cloths are arranged on a lower side of the first side of the sleeping bag body.

12. The swaddle baby sleeping bag according to claim 11, wherein the first side comprises a first portion and a second portion, and the zipper opening is defined between the first portion and the second portion.

13. The swaddle baby sleeping bag according to claim 12, wherein a lower recess is formed between a lower part of the first portion and a lower part of the second portion.

14. The swaddle baby sleeping bag according to claim 10, wherein the button seat is arranged on the second side of the sleeping bag body, and the button disk is arranged on the shielding cloth.

15. The swaddle baby sleeping bag according to claim 14, wherein a quantity of the button disk arranged on the shielding cloths is the same as a quantity of the button seat arranged on the second side of the sleeping bag body.

16. A swaddle baby sleeping bag, comprising a sleeping bag body and a zipper arranged on the sleeping bag body; wherein the sleeping bag body is defined with a head opening and a zipper opening, the head opening is located at an upper side of the sleeping bag body, and the zipper is arranged along the zipper opening; and the sleeping bag body comprises a main fabric area and two waist and hand fabric areas, and each of the two waist and hand fabric areas is symmetrically arranged on one side of the main body fabric area;

wherein an elasticity of the two waist and hand fabric areas is greater than an elasticity of the main fabric area.

17. The swaddle baby sleeping bag according to claim 16, wherein each waist and hand fabric area comprises a side recess, the side recess is an area with fabric, and the side recess faces the main fabric area.

18. The swaddle baby sleeping bag according to claim 16, wherein a lower recess is formed at a lower part of the sleeping bag body.

* * * * *